US011584495B2

(12) United States Patent
Hunziker, II

(10) Patent No.: US 11,584,495 B2
(45) Date of Patent: Feb. 21, 2023

(54) TROLLING MOTOR MOUNTING BRACKET

(71) Applicant: William Robert Hunziker, II, Parrish, FL (US)

(72) Inventor: William Robert Hunziker, II, Parrish, FL (US)

( * ) Notice: Subject to any disclaimer, the term of this patent is extended or adjusted under 35 U.S.C. 154(b) by 125 days.

(21) Appl. No.: 17/220,309

(22) Filed: Apr. 1, 2021

(65) Prior Publication Data

US 2022/0315189 A1 Oct. 6, 2022

(51) Int. Cl.
*B63H 20/00* (2006.01)
*B63H 20/06* (2006.01)

(52) U.S. Cl.
CPC ..... *B63H 20/06* (2013.01); *B63H 20/007* (2013.01)

(58) Field of Classification Search
None
See application file for complete search history.

(56) References Cited

U.S. PATENT DOCUMENTS 3,119,365 A 1/1964 Evans
3,251,333 A * 5/1966 Smenner ..... B63H 20/12 248/300
3,604,674 A 9/1971 Wilkerson
3,629,885 A * 12/1971 Jackson ..... B63H 20/007 248/642
3,765,369 A 10/1973 Henning
3,865,335 A 2/1975 Roller et al.
3,999,500 A 12/1976 Friedel et al.
4,154,417 A 5/1979 Foley, Jr.
4,432,527 A 2/1984 Sample
4,708,670 A 11/1987 Peters
4,734,068 A * 3/1988 Edwards ..... B63H 20/007 440/63
5,002,509 A 3/1991 Uroszek
5,358,434 A 10/1994 Brown
5,499,792 A 3/1996 Tamiso
5,941,742 A * 8/1999 Whitaker ..... B63H 20/007 114/364
7,004,804 B2 2/2006 Bernlochr et al.
7,294,029 B1 11/2007 Spaulding
7,828,614 B2 11/2010 Cribbs
8,814,129 B2 8/2014 Todd et al.
8,888,065 B2 11/2014 Logan
8,979,043 B2 * 3/2015 Florman ..... B23P 19/00 248/248
11,268,652 B2 * 3/2022 Garcia ..... H02B 1/044
11,407,481 B1 * 8/2022 Oliverio ..... B63H 20/12
2007/0023215 A1 10/2007 Lee

* cited by examiner

*Primary Examiner* — Steven M Marsh
(74) *Attorney, Agent, or Firm* — Edward M. Livingston, Esq.; Livingston Law, P.A.

(57) ABSTRACT

A trolling motor mounting bracket (1) which can be adjustably attached to a boat by a quick release handle (14) having pins (18) inserted through a chock (20) attached to the boat. The bracket has a support arm (4) with cradle rest (11) for supporting a shaft (18) of a trolling motor (6). The support arm be attached to the bracket by a hinge (10) which may have a spring that can be adjusted by a set screw (33) to increase resistance in the trolling motor support arm. A recessed cavity (24) in a base (31) of the bracket allows the bracket to be positioned variably on the chock.

12 Claims, 7 Drawing Sheets

TROLLING MOTOR MOUNTING BRACKET

FIELD OF THE INVENTION

This invention relates to boat motor mounting brackets and more particularly to an adjustable bracket for mounting a trolling motor to a bow of a fishing boat.

BACKGROUND OF THE INVENTION

Current typical fishing boats designed to fish in shallow waters, known in the vernacular as jon boats, have a motor mounted on a front side of the bow which is controlled by a long shaft, called a trolling arm, extending into the boat with controls at the end for a fisherman to vary depth and speed. Unfortunately, such trolling arms do not have proper and sufficient support which can cause damage to a motor shaft due to vibration, particularly in rough waters.

Another problem with current mounting brackets for trolling motors is that the mounting location on such brackets cannot be moved easily so as to account for different trolling motors and boats.

Also, theft of trolling motors is a problem and most mounting brackets do not provide deterrence from theft.

Therefore, a need exists for a trolling motor mounting bracket that provides support for a trolling arm, easy and variable location of a trolling motor and security from theft of trolling motors.

SUMMARY OF THE INVENTION

The primary object of the present invention is to provide a mounting bracket for a trolling motor that supports the trolling arm so as to prevent damage to the shaft of the trolling motor due to vibration from operation in rough waters.

Another object of the present invention is to provide such a trolling motor bracket that provides for easy and variable location and relocation of a trolling motor on the bracket which is mounted to one side at the bow of a boat.

Even another object of the present invention is to provide such a trolling motor mount that provides deterrence from theft of the trolling motor.

The present invention fulfills the above and other objects by providing a a trolling motor mounting bracket having an elongated motor mounting plate attached to a base having a top, a bottom, an outer side, an inner side and proximal and distal ends, with a trolling motor shaft support arm extending perpendicularly upward from the proximal end of the mounting plate. A chock attaches the bracket to a boat, said chock having apertures through it from top to bottom for inserting fasteners to attach the chock to the boat and apertures on its sides. A cavity in the bottom of the motor mounting plate to accommodates the boat mounting chock so that the motor mounting plate is movably locatable over the mounting chock within the cavity in the bottom of the base by removing the quick release handle from the base, moving the plate to a desired position within the cavity and chock to secure the motor mounting bracket to the boat mounting chock. A series of apertures in various locations on the top of the plate are provided for mounting trolling motors in variable positions. A quick release handle having at least one pin insertable into the apertures on an outer side of the base through the apertures on the side of the boat mounting chock. The trolling shaft support arm is adjustable in height. A recess on a distal end of the at least one pin on the quick release handle contains a recess onto which a cylinder lock can be attached to secure the bracket from removal from the chock.

The above and other objects, features and advantages of the present invention should become even more readily apparent to those skilled in the art upon a reading of the following detailed description in conjunction with the drawings wherein there is shown and described illustrative embodiments of the invention.

DESCRIPTION OF THE DRAWINGS

In the following detailed description, reference will be made to the attached drawings in which.

DESCRIPTION OF THE PREFERRED EMBODIMENTS

Figure 1:
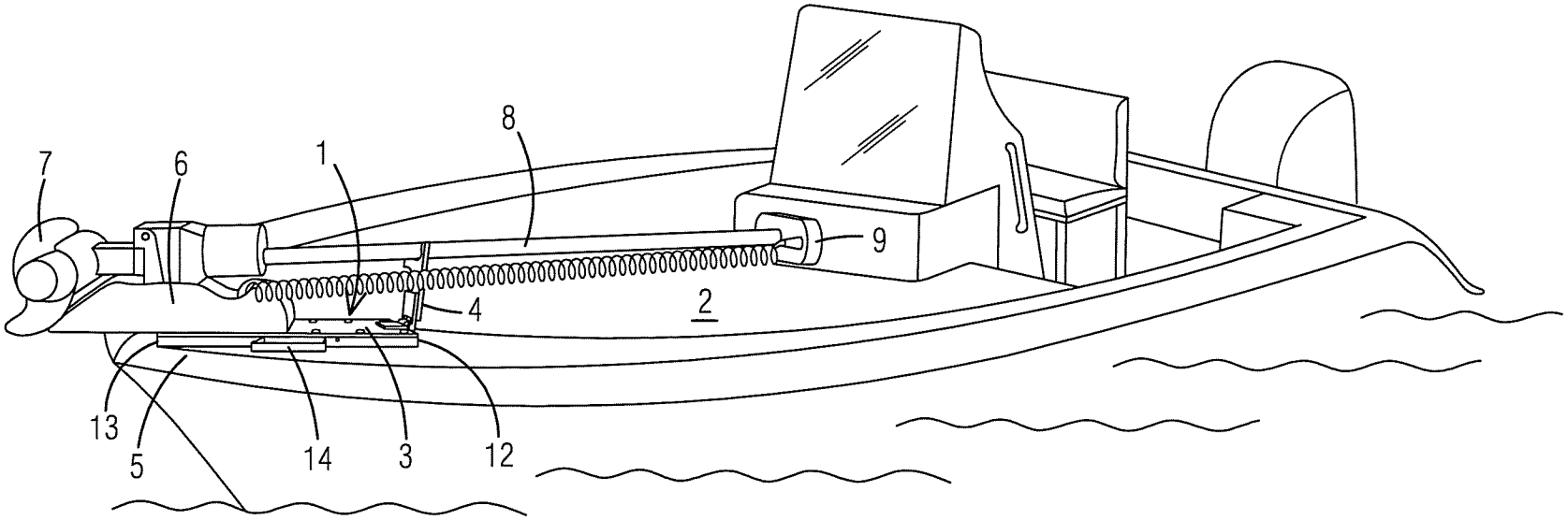
FIG. 1 is a perspective view of the trolling motor mounting bracket of the present invention on a boat.

For purposes of describing the preferred embodiment, the terminology used in reference to the numbered accessories in the drawings is as follows:

1. trolling motor mounting bracket, generally
2. boat
3. bracket plate top
4. support arm
5. bow of boat
6. trolling motor
7. propeller
8. trolling motor shaft
9. motor controls
10. support arm hinge
11. trolling arm cradle rest
12. proximal end of bracket
13. distal end of bracket
14. quick release handle
15. quick release handle pin apertures
16. trolling motor mounting apertures
17. support arm handle
18. quick release pins
19. bracket lock
20. boat attachment chock
21. chock apertures
22. inner side of bracket
23. outer side of bracket
24. chock cavity
25. bottom of mounting bracket

26. support arm adjustment plate
27. support arm adjustment apertures
28. support arm mounting screws
29. quick release handle spindle pins
30. lock recess
31. base
32. plate to base attachment screws
33. wide pin section
34. support arm hinge spring screw Referring now to the FIG. 1, the trolling motor mounting bracket 1 is illustrated in perspective mounted on a bow 5 of a boat 2 as it would appear in use. The bracket 1 has a top plate 3 and base 31 which is attached to a gunnel of the boat 2 by a chock 20 (as shown and described later in relation to FIG. 6) by a quick release handle 14. A trolling motor 6 having a propeller 7, which is adjustably attached in a desired location on the top plate 3 proximate a distal end 13 of the top plate 3 of the bracket 1. The trolling motor arm 8 extends from the trolling motor 6 to the motor controls 9 where it is controlled by the boat operator, and is supported by a perpendicularly upward support arm 4 hingedly attached to a proximal end 12 of the top plate 3 of the bracket 1.

Figure 2:
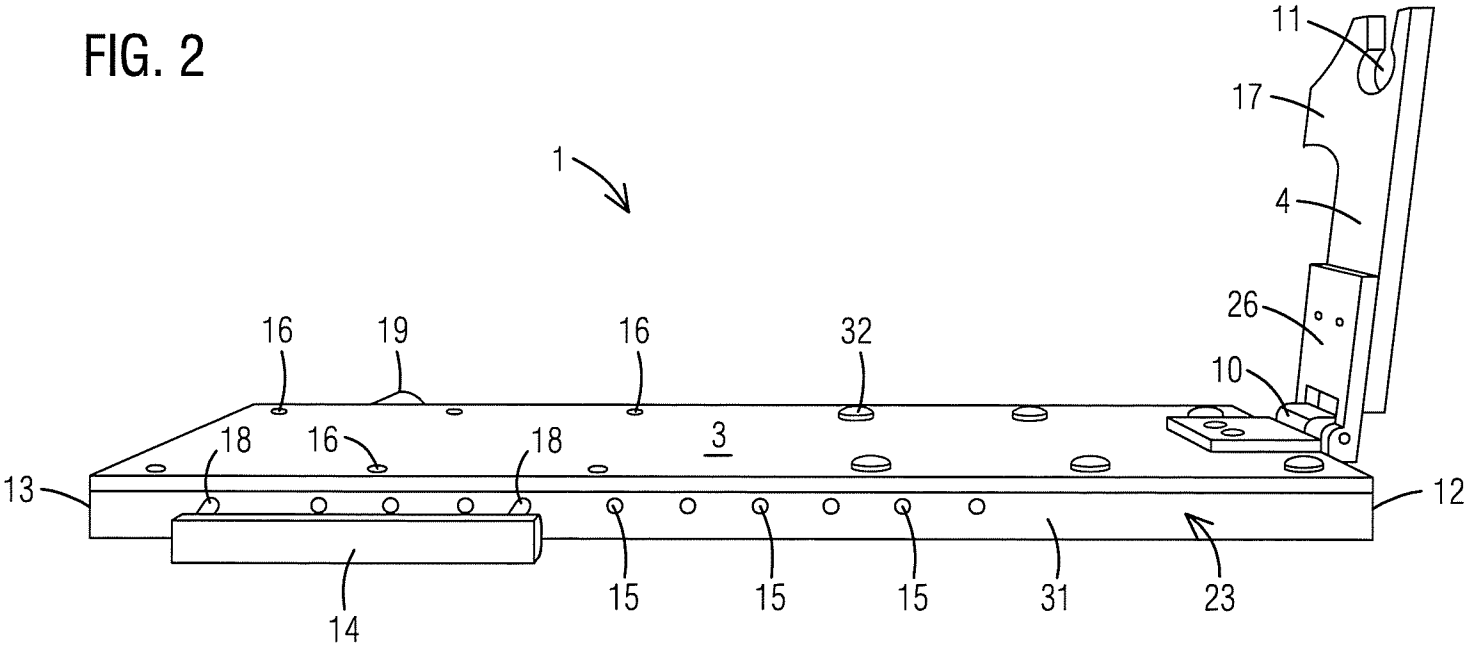
FIG. 2 is an outer side perspective view of the trolling motor mounting bracket of the present invention.

FIG. 2 shows a perspective view of the trolling motor mounting bracket 1 by itself from the outer side 23. The bracket 1 has a top plate 3 attached to a base 31 and a trolling motor shaft support arm 4 hingedly attached to an adjustment plate 26 by a hinge 10 attached to a proximal end 12 of the bracket 1. The support arm 4 has a cradle 11 in a top into which the trolling arm 8 shown in FIG. 1 rests. A handle 17 proximate a top of the support arm 4 makes it easier to raise the support arm 4 up in a use position or fold it down in a nonuse mode as shown in FIG. 4.

FIG. 2 also shows the top plate 3 of the bracket 1 having a plurality of apertures 16 for securing a trolling motor in a desired location on the plate 3. A quick release handle 14 has pins 18 which are insertable through apertures 15 in the outer side of the bracket 23 of the base 31 which pass through apertures in a chock as described later to secure the bracket 1 to a boat 2 (not shown in FIG. 2) and enable the bracket to be quickly attached and removed from a boat 2. A lock, such as the cylinder lock 19 on an end of one of the pins 18 can be used to deter theft of the bracket 1 with attached trolling motor 6 (not shown in FIG. 2).

Figure 3:
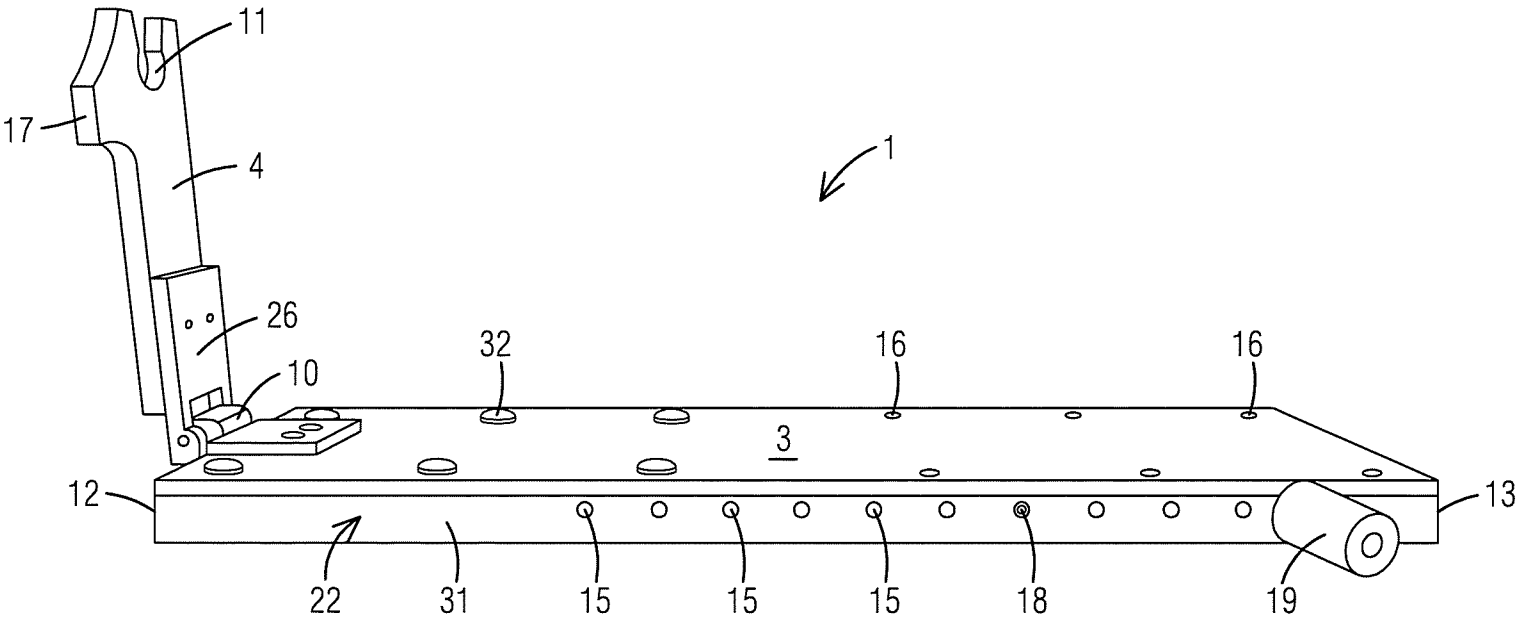
FIG. 3 is an inner side perspective view of the trolling motor mounting bracket of the present invention.

Referring now to the FIG. 3, a side perspective view of the trolling motor mounting bracket 1 is shown from the inner side 22. In addition to other components and features of the bracket 1 previously discussed, this inner view shows the plurality of apertures 15 for inserting the pins 18 of the quick release handle 14 which allow a user to vary the location of a trolling motor 6 (not shown in FIG. 3) on the trolling motor mounting bracket 1. FIG. 3 also shows the cylinder lock 19 which is attached to one of the quick release spindle pins 18 to deter theft of the trolling motor mounting bracket 1.

Figure 4:
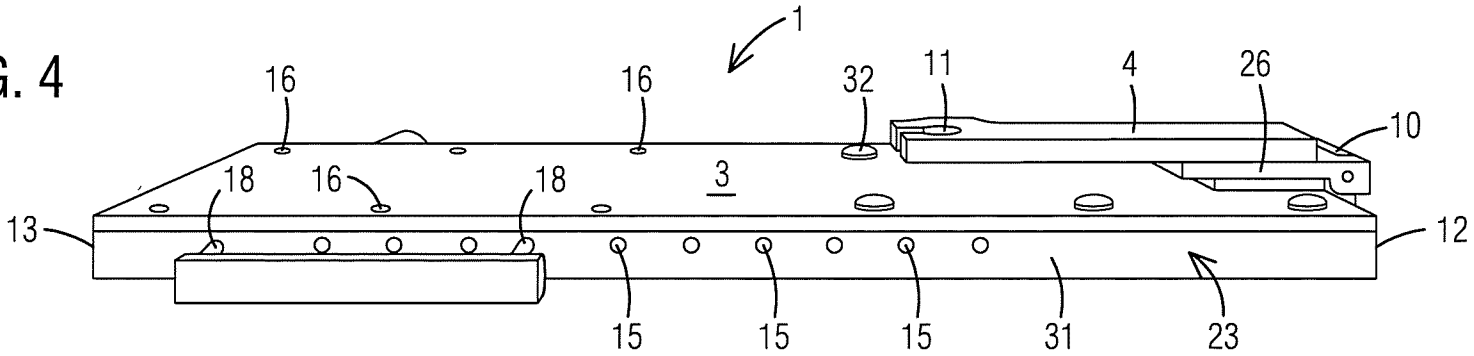
FIG. 4 is an outer side view of the trolling motor mounting bracket of the present invention with the trolling motor shaft support arm in a folded non-use position.

FIG. 4 is a view from the outer side 23 of the bracket 1 which shows the support arm 4 for a shaft of a trolling motor 6 (not shown in FIG. 4) folded down in a nonuse mode made possible by the hinge 10 used to attach the support arm 4 to the proximal end 12 of the top plate 3.

Figure 5:
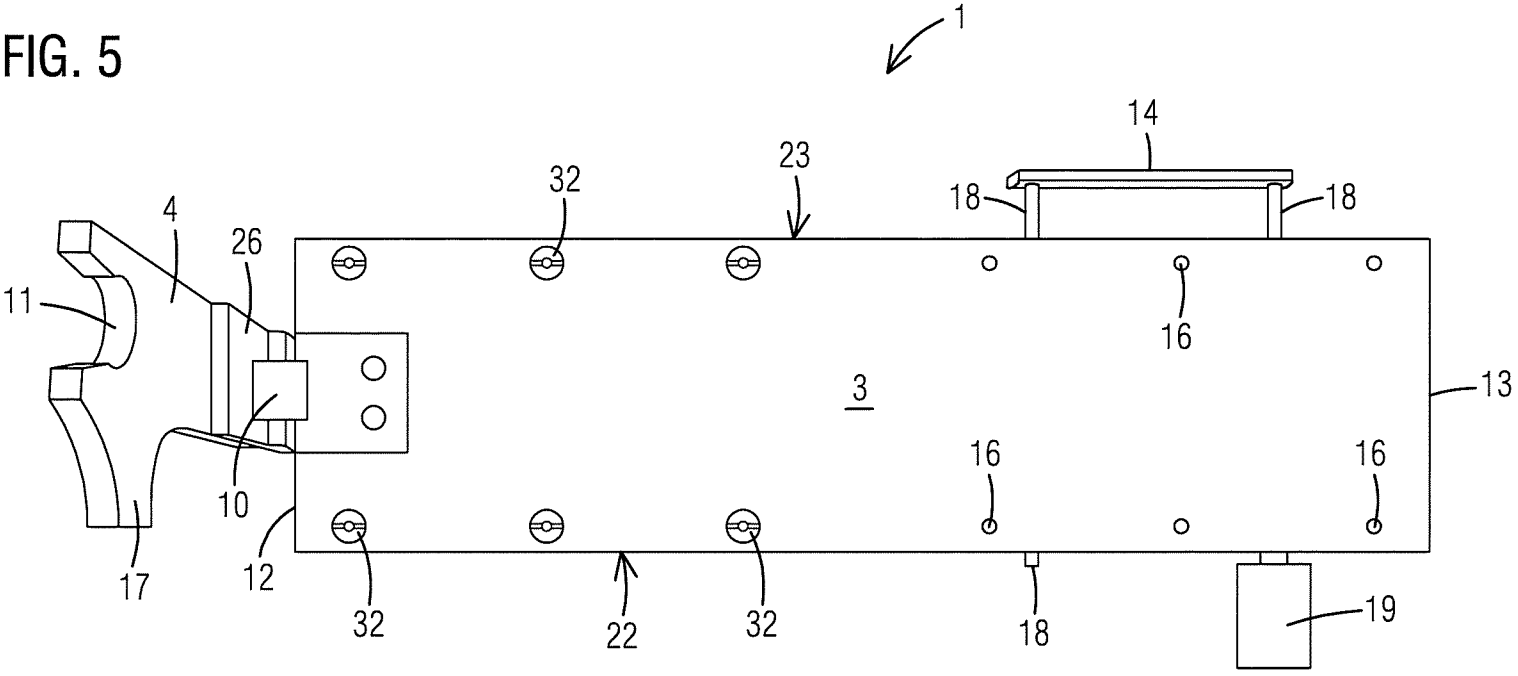
FIG. 5 is a top view of the trolling motor mounting bracket of the present invention.

FIG. 5 shows the trolling motor mounting bracket 1 from a top view. In this view, the attachment screws 32 for fastening the top plate 3 to the base 31 of the bracket are shown. The support arm 4 with trolling shaft cradle rest 11 and handle 17 is secured to the adjustment plate 26 which in turn is attached by hinge 10 to the proximal end of the bracket 12 are shown. The quick release handle 14 with pins 18 passing through apertures 15 in the base 31 are shown with a cylinder lock 19 securely attached on an end of one of the pins 18.

Figure 6:
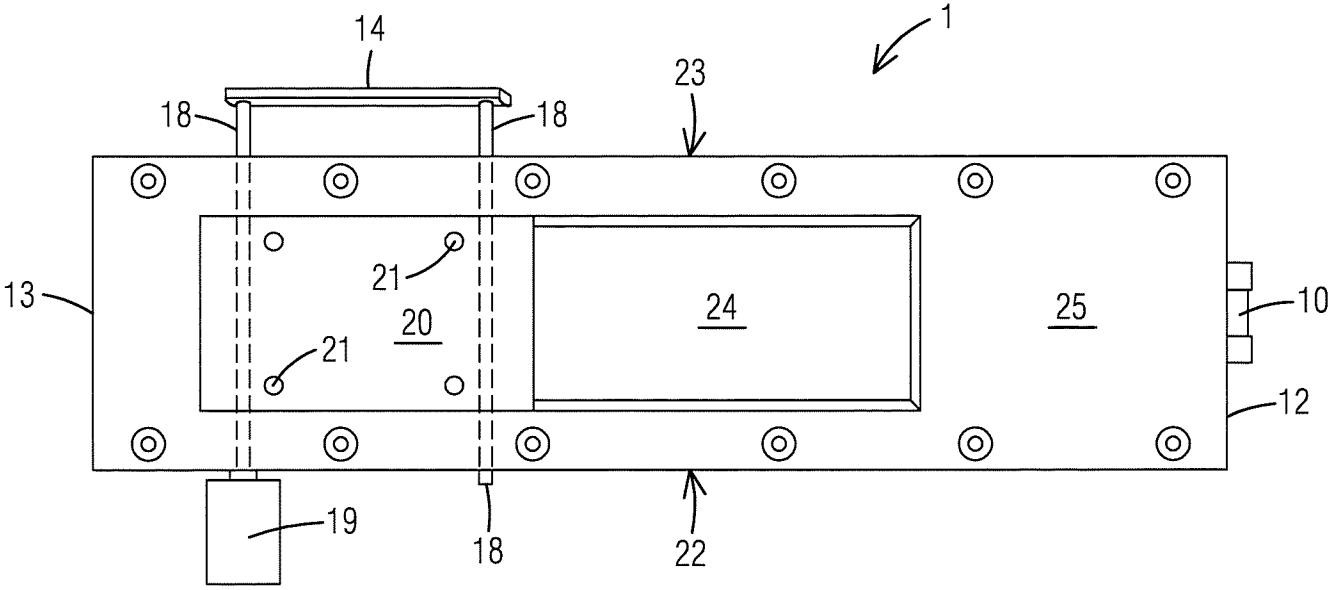
FIG. 6 is a partial bottom plan view of the trolling motor mounting bracket of the present invention showing in plan view the pins on the quick release handle passing through the bracket and chock.

FIG. 6 illustrates in partial plan view the trolling motor mounting bracket 1 from the bottom. 25. In addition to other features discussed in relation to the other drawing figures, this bottom view best illustrates the chock 20 used to attach the bracket 1 to a boat by screws or bolts inserted through apertures 21. A recessed cavity 24 allows the bracket 1 to be adjustably and variably positioned toward or away from the bow of a boat depending on the size of the trolling motor or desires of the user, merely by pulling out the quick release handle 14 from the outer side 25 to remove the pins 18 from the base 31 and chock 20, moving the bracket to a desired position and then reinserting the quick release handle 14 and pins 18 through the apertures 15 in the outer side 25 of the base 31 through aligned apertures 21 in the side of the chock 20 to secure the bracket 1 in the new position.

Figure 7:
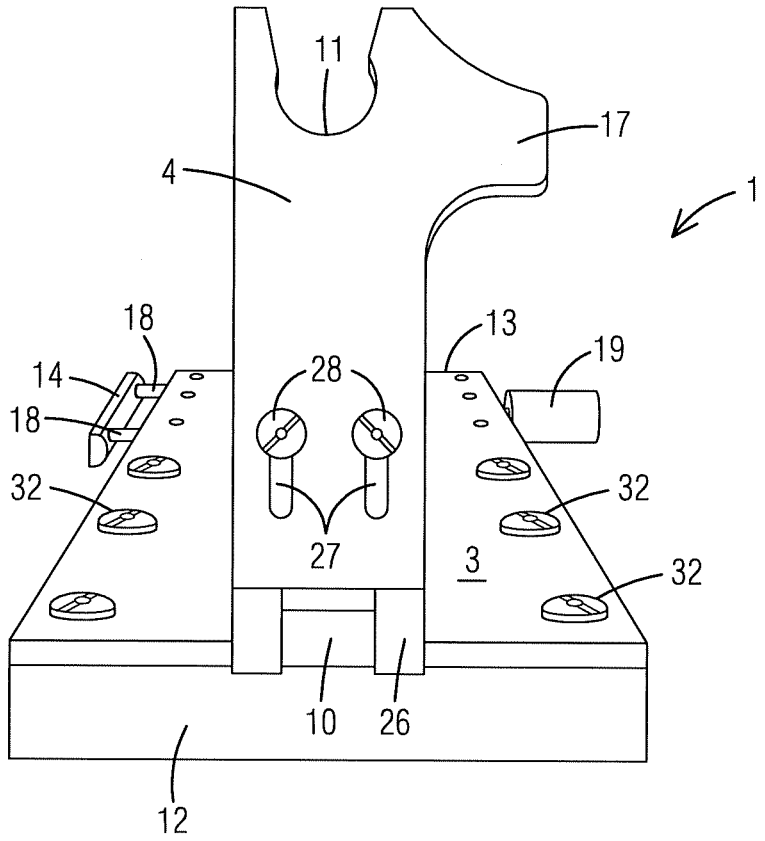
FIG. 7 is a proximal end perspective view of the trolling motor mounting bracket of the present invention.

FIG. 7 shows a proximal end perspective view of the trolling motor mounting bracket 1, which in addition to illustrating features of the bracket already discussed in relation to other drawing figures, illustrates the support arm 4 with cradle rest 11 on top with side handle 17 and height adjustment screws 28 for adjustably attaching the support arm 4 to the plate 26 which in turn is hingedly mounted by hinge 10 to the top plate 3 of the bracket 1.

Figure 8:
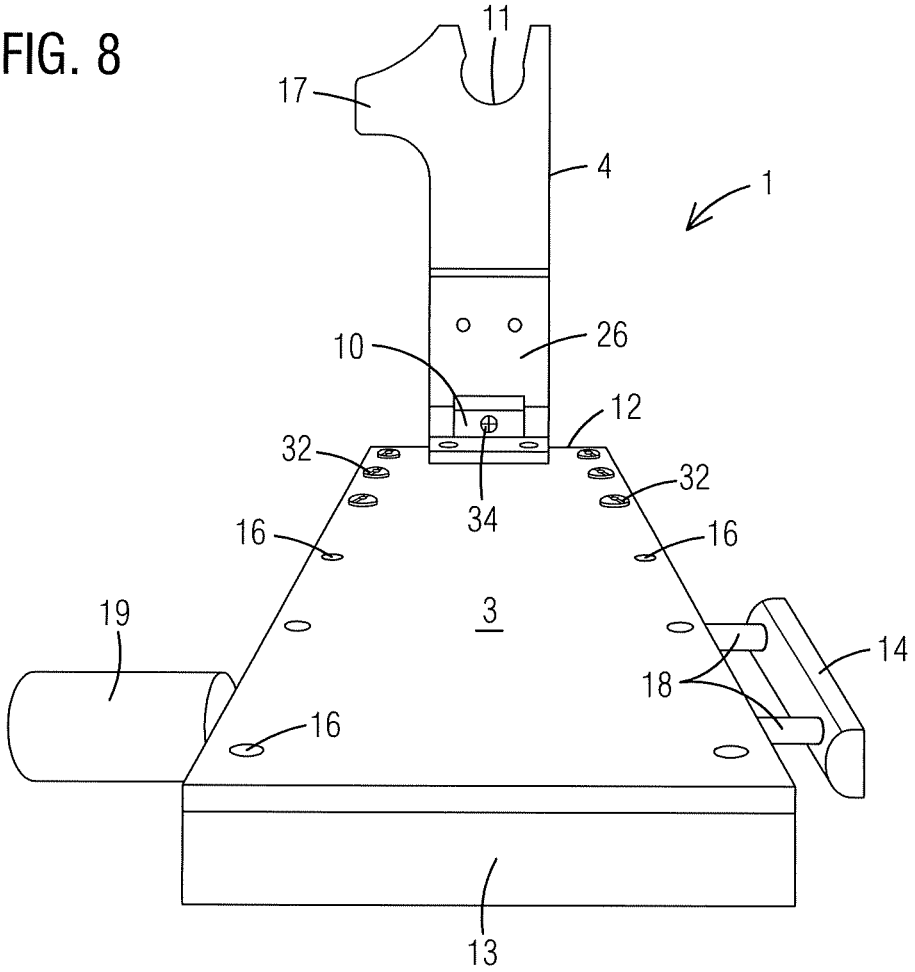
FIG. 8 is a distal end perspective view of the trolling motor mounting bracket of the present invention.

FIG. 8 illustrates the trolling motor mounting bracket 1 in perspective from the distal end 13 which shows once again the features of the bracket 1 having a top plate 3 secured to a base 31 by screws 32, the support arm 4 and quick release handle 14. A set screw 34 is used to adjust tension of a spring in the hinge 10 to increase or decrease folding resistance of the support arm as desired for various weights of trolling arms.

Figure 9:
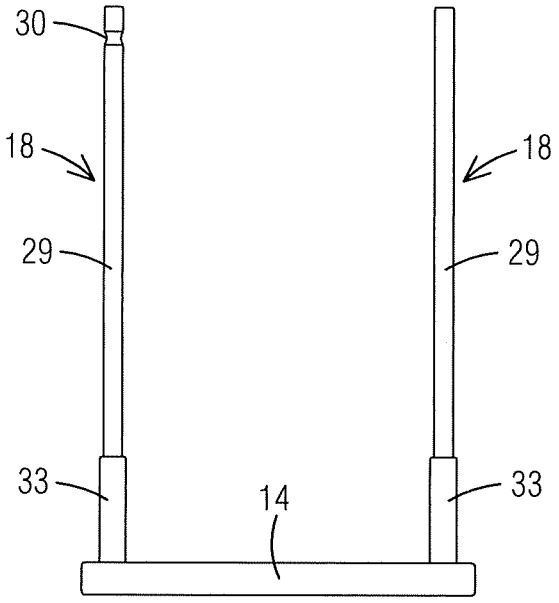
FIG. 9 is a top view of the quick release handle of the trolling motor mounting bracket of the present invention.

The final drawing in FIG. 9 shows a top view of the quick release handle 14 which is essential to adjustably securing the trolling motor mounting bracket 1 to the chock 20 attached to a boat 2 (not shown in FIG. 9). The pins 18 have a wider diameter section 33 that abuts the outer side 23 of the base 31 and a smaller diameter section 29 that can be inserted through apertures in the chock 20 to attach the bracket 1 to a boat 2. A recess 30 on an end of the pin 18 can allow the attachment of a cylinder lock 19 as previously discussed to secure the trolling motor mounting bracket 1 from theft.

It is to be understood that while a preferred embodiment of the invention is described, it is not to be limited to the specific form or arrangement of parts herein described and shown. It will be apparent to those skilled in the art that various changes may be made without departing from the scope of the invention and the invention is not to be considered limited to what is shown and described in the specification and/or drawings.

Having thus described my invention, I claim:

1. A trolling motor mounting bracket for mounting a trolling motor to a boat comprising:

an elongated motor mounting plate having a top, a bottom, an outer side, an inner side and proximal and distal ends;

a base to which the mounting plate is attached;

a trolling motor shaft support arm extending perpendicularly upward from the proximal end of the mounting plate;

a boat attachment chock for mounting the base to the boat, said chock having apertures through it from top to bottom for inserting fasteners to attach the chock to the boat and apertures through sides of the chock;

a cavity in the base below the mounting plate to accommodate the boat mounting chock;

apertures on the top of the plate for mounting a trolling motor; and a quick release handle having at least one pin insertable into the apertures on an outer side of the base and through the apertures on a side of the boat mounting chock to secure the motor mounting bracket to the boat mounting chock.

2. The trolling motor mounting bracket of claim 1 wherein the motor mounting plate and base are movably locatable over the chock within the cavity by pulling the quick release handle and the at least one pin from the outer side of the base, moving the bracket to a desired position within the cavity and reinserting the quick release handle with pins through the aperture in the side of the base and the motor mounting chock.

3. The trolling motor mounting bracket of claim 1 wherein the trolling shaft support arm is adjustable in height.

4. The trolling motor mounting bracket of claim 1 further comprising a recess on a distal end of the at least one pin on the quick release handle contains a recess onto which a cylinder lock can be attached to secure the bracket from removal from the chock.

5. The trolling motor mounting bracket of claim 3 wherein the trolling motor shaft support arm is adjustable in height by being mounted to an attachment plate having vertically-elongated apertures with screws for securing the support arm at a desired height.

6. The trolling motor mounting bracket of claim 1 wherein the trolling motor shaft support arm is hingedly-mounted to the plate to enable it to be folded downward to a planar position on the plate when said arm is not in use.

7. The trolling motor mounting bracket of claim 6 wherein the trolling motor shaft support arm has a spring within the hinge to adjust tension placed on the arm.

8. A trolling motor mounting bracket for mounting a trolling motor to a boat comprising:

an elongated motor mounting plate having a top, a bottom, an outer side, an inner side and proximal and distal ends;

a base to which the mounting plate is attached;

a trolling motor shaft support arm extending perpendicularly upward from the proximal end of the plate;

a boat attachment chock for mounting the plate and base to the boat, said chock having apertures through it from top to bottom for inserting fasteners to attach the chock to the boat and apertures through sides of the chock;

a cavity in the base to accommodate the boat mounting chock;

apertures on the top of the plate for mounting a trolling motor;

a quick release handle having at least one pin insertable into the apertures on an outer side of the base through the apertures on a side of the boat mounting chock to secure the motor mounting plate to the boat mounting chock;

wherein the motor mounting plate and base are movably locatable over the attachment chock within the cavity by pulling the quick release handle and the at least one pin from the outer side of the base, moving the bracket to a desired position within the cavity and reinserting the quick release handle with pins through the aperture in the side of the base and the chock; wherein the trolling support arm is adjustable in height; and wherein the at least one pin on the quick release handle contains a recess onto which a cylinder lock can be attached to secure the bracket from removal from the chock.

9. The trolling motor mounting bracket of claim 6 wherein the trolling motor shaft support arm is adjustable in height an attachment plate having vertically-elongated apertures with screws for securing the support arm at a desired height.

10. The trolling motor mounting bracket of claim 1 wherein the trolling shaft support arm is hingedly attached to the mounting plate so the support may be folded downward when a trolling motor is not secured to the bracket.

11. The trolling motor mounting bracket of claim 6 wherein the trolling shaft support arm is hingedly attached to the mounting plate so the support may be folded downward when a trolling motor is not secured to the bracket.

12. The trolling motor mounting bracket of claim 11 wherein the trolling motor shaft support arm has a spring within the hinge to adjust tension placed on the arm.

* * * * *